US006546942B2

(12) United States Patent
Smith et al.

(10) Patent No.: US 6,546,942 B2
(45) Date of Patent: Apr. 15, 2003

(54) DISHWASHER WITH AUXILIARY BASKET

(75) Inventors: John I. Smith, Coloma, MI (US); Jeffrey R. Taylor, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 135 days.

(21) Appl. No.: 09/836,494

(22) Filed: Apr. 17, 2001

(65) Prior Publication Data

US 2002/0148494 A1 Oct. 17, 2002

(51) Int. Cl.[7] ..... A47L 15/50
(52) U.S. Cl. ..... 134/201; 211/41.8
(58) Field of Search ..... 134/201; 211/41.8, 211/41.9, 181.1

(56) References Cited

U.S. PATENT DOCUMENTS

| | | | | |
|---|---|---|---|---|
| 3,098,685 A | | 7/1963 | Stiner et al. | 312/311 |
| 4,046,261 A | | 9/1977 | Yake | 211/41 |
| 4,183,437 A | | 1/1980 | Crawford et al. | 211/41 |
| 4,475,656 A | | 10/1984 | Collier | 211/41 |
| 4,834,125 A | * | 5/1989 | Insalaco | 134/201 |
| 5,158,185 A | * | 10/1992 | Michael et al. | 134/201 X |
| 5,205,419 A | | 4/1993 | Purtilo | 211/41 |
| 5,462,348 A | | 10/1995 | Ellingson et al. | 312/301 |
| 5,480,035 A | | 1/1996 | Smith | 211/41 |
| 5,980,009 A | | 11/1999 | Atalla et al. | 312/408 |

* cited by examiner

*Primary Examiner*—Philip Coe

(57) ABSTRACT

The invention addresses the need for an automatic dishwasher that can accommodate various shapes and sizes of utensils. The invention relates to an automatic dishwasher comprising a cabinet that defines a washing chamber. The cabinet has an access opening, which is closeable by a door that is moveably mounted to the cabinet between an open position and a closed position. A first basket is moveably mounted within the washing chamber and capable of movement between a use position and a load position. An auxiliary basket assembly comprising an auxiliary basket and an auxiliary basket support for support the auxiliary basket above the first basket.

48 Claims, 10 Drawing Sheets

DISHWASHER WITH AUXILIARY BASKET

BACKGROUND OF THE INVENTION

1. Field of the Invention

This invention relates to an automatic dishwasher comprising a basket for holding various types of cooking utensils. In one aspect, the invention includes an auxiliary basket mounted above the main basket. In another aspect, the auxiliary basket is removably mounted to the main basket or moveable between a use and a storage position.

2. Related Art

Automatic dishwashers are well known, especially those for use in household environments. A typical automatic dishwasher comprises a cabinet that defines a washing chamber, which is accessible through a moveable door. Typically, an upper and a lower basket for holding cooking utensils to be cleaned are provided within the washing chamber. A silverware basket is also usually provided and normally mounts to the lower basket. The upper and lower baskets are normally spaced so that larger utensils can be positioned in the lower basket and smaller utensils in the upper basket. Both the upper and lower baskets are slideably mounted within the washing chamber in such a manner that they can be slid substantially beyond the washing chamber to ease the loading of the baskets.

The types of utensils placed in an automatic dishwasher can vary greatly in size. Some utensils are very large, such as soup pots and roasting pans, other utensils are relatively small, such as silverware, serving spoons, and spatulas. The baskets must also accommodate the traditional utensils of plates, glasses, saucer plates, mugs, etc. Since the utensil composition can vary greatly from load to load, contemporary automatic dishwashers must be configured or easily adaptable to accommodate these various size utensils to maximize the number of utensils washed during a given load. The maximization of the number of utensils in each load is a great convenience for the user and also reduces energy and water consumption.

The shape of some utensils are such that they can effectively reduce the effective holding capacity of the automatic dishwasher, and thereby increase the need for multiple loads, resulting in an inefficient use of resources. An example of such a utensil is any utensil having a long and slender profile, such as a wooden spoon, a spatula, a ladle, etc. Often times, the length of these utensils makes it impossible for them to stand up within the silverware basket because the utensil will contact the other basket. To wash these type of utensils it is necessary to lay them down in either the upper or lower basket where they often extend across a substantial portion of the basket floor. Since for best cleaning it is not desirable to place other items on top of the elongated utensils, the elongated utensils fill a space that would otherwise accommodate many other utensils, effectively reducing the capacity of the given load.

It is desirable to have an automatic dishwasher that can accommodate all shapes and sizes of utensils without dramatically sacrificing overall capacity or reserving permanent space in one of the baskets for the odd shaped utensil.

SUMMARY OF THE INVENTION

The invention addresses the need for an automatic dishwasher that can accommodate various shapes and sizes of utensils. The invention relates to an automatic dishwasher comprising a cabinet that defines a washing chamber. The cabinet has an axis opening, which is closeable by a door that is moveably mounted to the cabinet between an open position and a closed position. A first basket is moveably mounted within the washing chamber and capable of movement between a use position and a load position. The first basket comprises a bottom wall, opposing front and rear walls, and opposing side walls that connect the front and rear walls to form a peripheral wall that extends upwardly from a bottom wall. An auxiliary basket assembly is provided and comprises an auxiliary basket support and an auxiliary basket that is removably mounted to the first basket by the auxiliary basket support. The auxiliary basket support supports the auxiliary basket above the first basket.

The auxiliary basket support preferably comprises at least one support that is rotatably mounted to the first basket for rotation between a support position, where the support is positioned to support at least a portion of the auxiliary basket, and a retracted position, where the support does not interfere with access to the utensil receiving area.

Preferably, the auxiliary basket support assembly supports the auxiliary basket in either of a side wall-to-side wall or front wall-to-rear wall orientation. When the auxiliary basket is in the side wall-to-side wall orientation and the at least one support is in the support position, the at least one support is generally parallel to one of the front and rear walls. When the auxiliary basket is in the rear wall-to-front wall orientation and the at least one support is in the support position, the at least one support is generally parallel to one of the side walls.

The automatic dishwasher can include a second basket which is moveably mounted within the wash chamber. The second basket is preferably disposed above the first basket.

The at least one support comprises a post and an arm that extends from the post. The post is generally parallel to a portion of the peripheral wall and is rotatably mounted thereto. The arm overlies the utensil receiving area when the support is in the support position and does not interfere with access to the utensil receiving area when the support is in the retracted position. The post is preferably located at a junction of one of the side walls in one of the front end rear walls. Thus, when the support is in the retracted position, the arm is substantially aligned with and adjacent to one of the side walls or rear wall. A second support can be provided and is preferably located at a junction of the other one of the side walls and the other of the front and rear walls.

The arm and the post can define a recess in which is received a portion of the auxiliary basket when the auxiliary basket is mounted to the first basket. Additionally, the arm and the post can further define a vertically orientated slot that is sized to receive at least a portion of the auxiliary basket and retain the basket in a substantially vertical position. The slot preferably has a mouth which opens into the recess to permit the movement of the auxiliary basket from a generally horizontal position to a substantially vertical position.

Preferably, the arm and post are made of shaped wire, with the arm comprising a base portion that terminates in an arm stop and the post comprising a base portion that extends in a direction opposite the arm base portion and terminates in a post stop. The recess is defined by the arm and post base portions and their corresponding stops.

The automatic dishwasher can further comprise a first clip that mounts the support to the first basket for rotation relative to the peripheral wall. The first clip preferably comprises an opening and first and second channels, which extend away from the opening and are angularly oriented relative to each other. The post is received within the opening to thereby permit the raising and lowering and rotation of the support relative to the first clip such that the arm can be received in the first channel to place the support in the support position or in the second channel to place the support in the retracted position. Preferably, the first clip is mounted at a junction of the one of the side walls with one of the front and rear walls. The first and second channels are preferably oriented at a right angle relative to each other. A second clip can be provided and is mounted to the first basket. The second clip defines a second opening through which the post passes. The post preferably includes an enlarged portion located below the second opening, with the enlarged portion being of a size to prevent it from passing through the opening of the second clip to thereby limit the amount the support can be raised relative to the first basket.

The auxiliary basket support assembly can further comprise a second support. The first support is located at a junction of one of the side walls and the front wall and the second support is located at a junction of the one of the side walls and the rear wall.

In another aspect, the invention relates to an auxiliary basket assembly for a dishwasher. The auxiliary basket assembly comprises an auxiliary basket and an auxiliary basket support that removably mounts the auxiliary basket to another basket.

In yet another aspect, the invention relates to an automatic dishwasher having an auxiliary basket assembly comprising a pair of auxiliary basket supports that support an auxiliary basket above a basket. Each of the supports have an arm for supporting the auxiliary basket in a use position and a slot for supporting the auxiliary basket in a stored position.

DETAILED DESCRIPTION OF THE PREFERRED EMBODIMENT

Figure 1:
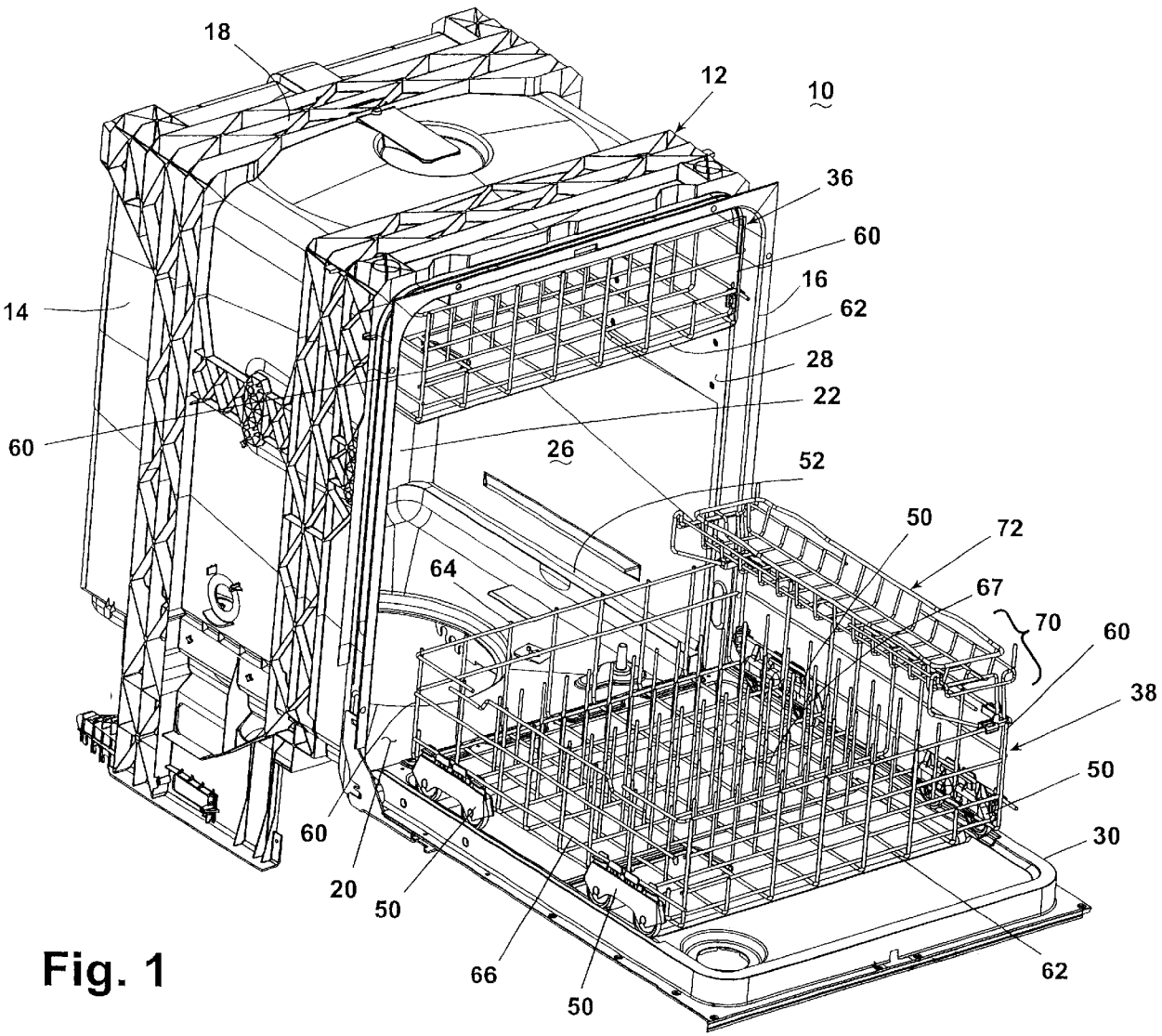
FIG. 1 is a perspective view of an automatic dishwasher of the built-in type having a housing defining a wash chamber that is closed by a door and an upper and lower basket mounted to the housing within the wash chamber for slidable movement relative to the wash chamber.

FIG. 1 illustrates an automatic dishwasher 10 comprising an open-faced cabinet or tub 12 having side walls 14, 16, whose upper and lower ends are connected by top wall 18 and a bottom wall 20, respectively, and all of which extend away from a rear wall 22. The walls of the open-faced cabinet 12 define a washing chamber 26 to which access is obtained through a front opening 28 defined by the forward edges of the top wall, bottom wall, and side walls. A door 30 is hingedly mounted to the cabinet for movement between an open position (shown), where the door 30 is generally horizontal, to a closed position, where the door 30 covers the access opening 28 and seals the washing chamber 26.

It should be noted that the dishwasher shown in FIG. 1 is a built-in type designed to be mounted within a cabinet system and does not have an external or decorative housing. The invention as described herein applies to all types of automatic dishwashers regardless of the particular type. The automatic dishwasher of FIG. 1 is also shown without the pump, heating element, and water spray for clarity. These features are well known and are not germane to the invention.

The automatic dishwasher 10 further comprises upper and lower baskets 36, 38 for holding utensils of various shapes and sizes. Both of the upper and lower baskets, 36, 38 are preferably mounted to the housing within the washing chamber for movement into and out of the washing chamber 26 through the access opening 28 to permit the movement of the baskets between a cleaning position, where the baskets are retained entirely within the washing chamber 26, to a load position, where at least a substantial portion of the baskets 36, 38 extend out of the washing chamber 26 through the access opening 28 to increase the ease of loading the baskets with utensils. The upper basket 36 is shown in the cleaning position and the lower basket 38 is shown in the loading position.

The upper basket 36 is preferably moveably mounted within the washing chamber 26 in the traditional manner such as by mounting wheels (not shown) to the tub and basket and having a free floating track over the basket wheels and between the tub wheels.

The lower basket 38 preferably comprises one or more wheel or roller assemblies 50 that rest upon a ledge 52 extending from the side walls 14, 16. The ledges 52 generally align with the upper surface of the door 30 when it is in the open position to permit the lower basket 38 to slide from the ledges 52 and onto the upper surface of the door 30 when the lower basket 38 is moved from the cleaning position to the loading position.

Both the upper and lower baskets 36, 38 have the same general wire-frame construction and configuration. Each of the baskets 36, 38 comprise side walls 60 whose ends are connected by a front wall 62 and rear wall 64 that collectively form a generally rectangular peripheral wall that extends upwardly from a bottom wall 66. The peripheral wall and the bottom wall define a utensil receiving area 67. A plurality of positioning tines 68 extend upwardly from the bottom wall of both the upper and lower baskets into the corresponding utensil receiving area and aid in positioning the various shapes and sizes of utensils within each basket.

Figure 2:
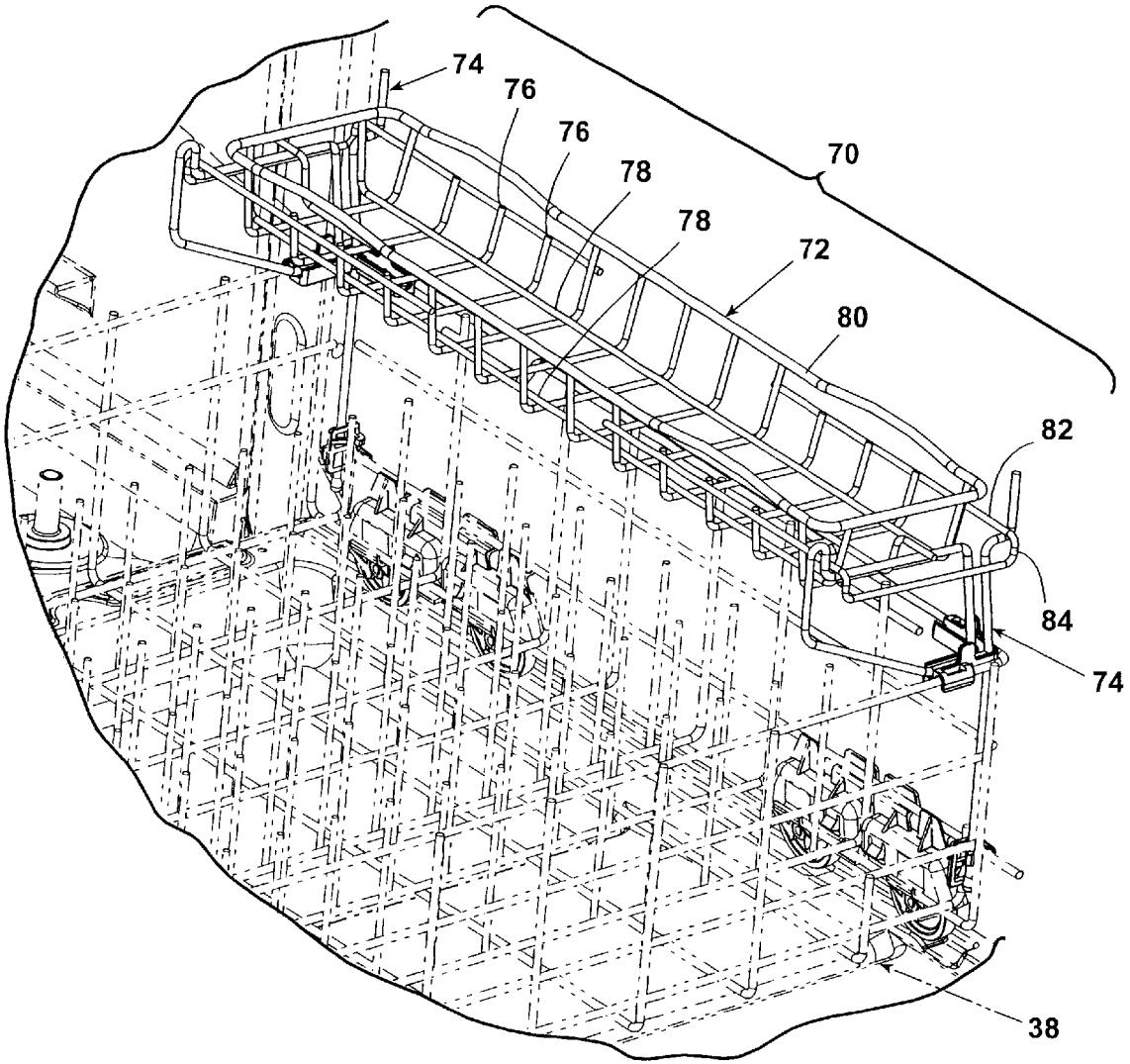
FIG. 2 is an enlarged perspective view of the lower basket of FIG. 1 and illustrating an auxiliary basket mounted to the lower basket in a use position by an auxiliary basket support assembly, with the lower basket shown in phantom lines for clarity.

FIG. 2 is a perspective view of the lower basket 38 with an auxiliary basket assembly 70 mounted to the lower basket 38, which is shown is phantom to more clearly illustrate the auxiliary basket assembly 70. The auxiliary basket assembly 70 comprises an auxiliary basket 72 and a basket support assembly 74 that mounts the auxiliary basket 72 above and over the utensil receiving area 67 of the lower basket 38 in a front wall-to-rear wall orientation and adjacent the side wall 60.

As illustrated, the auxiliary basket 72 has an elongated profile and comprises multiple transversely-oriented wire frame base members 76 that are connected to elongated base members 78, which collectively define the bottom and peripheral wall for the auxiliary basket 72. Some of the transverse base members 76 extend upwardly a greater amount than the other base members and are connected at their upper ends by a peripheral wire frame lip 80 that forms an upper edge to the auxiliary basket. The other transverse base members have their upper ends connected to a pair of wire frame carriers 82 having downwardly turned ends 84 and are mounted to the transverse base member 76 and extend outwardly beyond the ends of the auxiliary basket 72.

Referring to FIGS. 3–6, the basket support assembly 74 comprises a pair of supports 90 that are mounted by upper and lower clips 92, 94 to the peripheral wall of the lower basket 38 at the junction of the side wall 60 and front wall 62 and the side wall 60 and rear wall 64, respectively.

Figure 3:
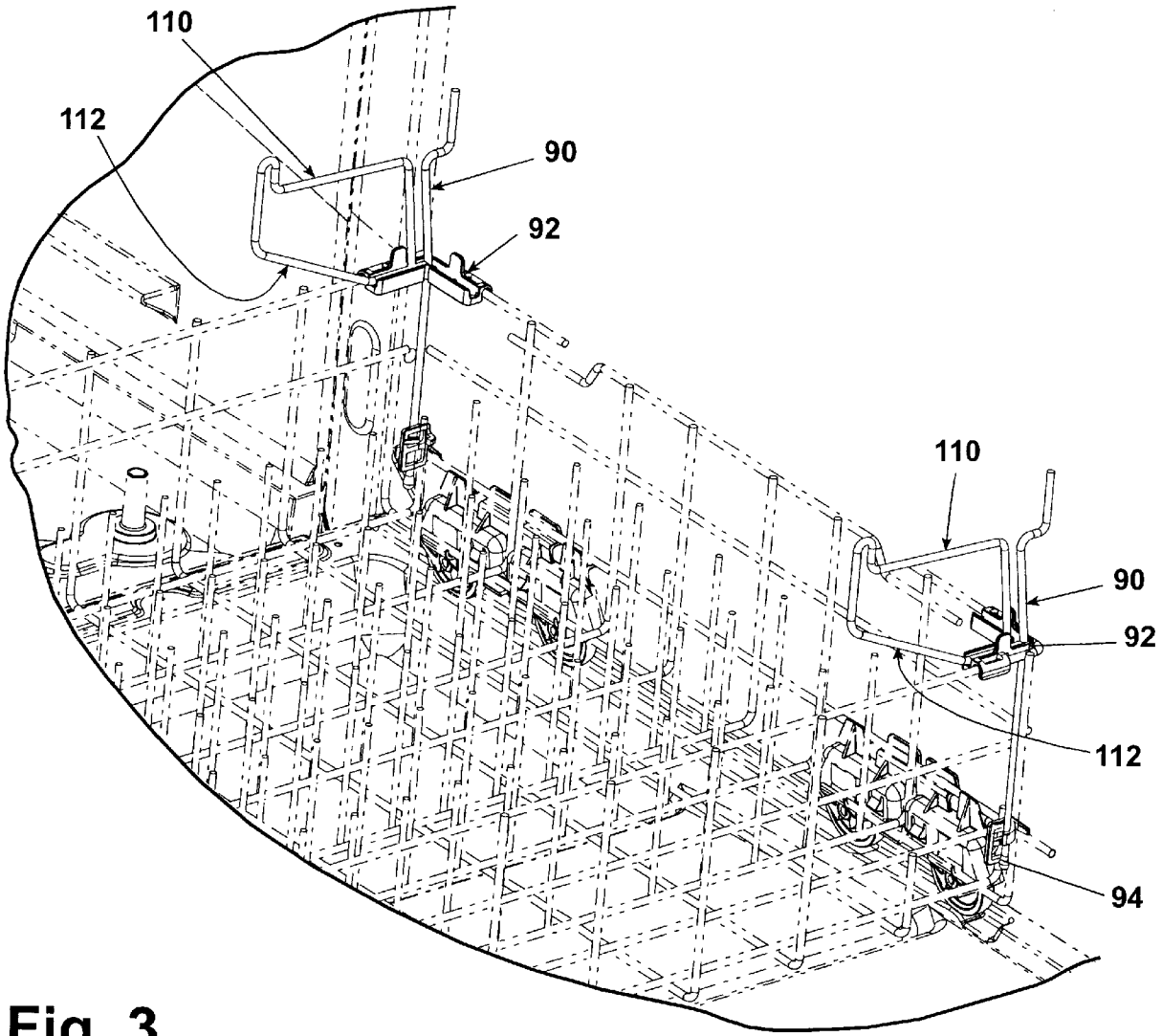
FIG. 3 is a perspective view similar to FIG. 2 except that the auxiliary basket is removed to better illustrate a pair of auxiliary basket supports for the auxiliary basket support assembly, with the supports shown in a use position.
Figure 4:
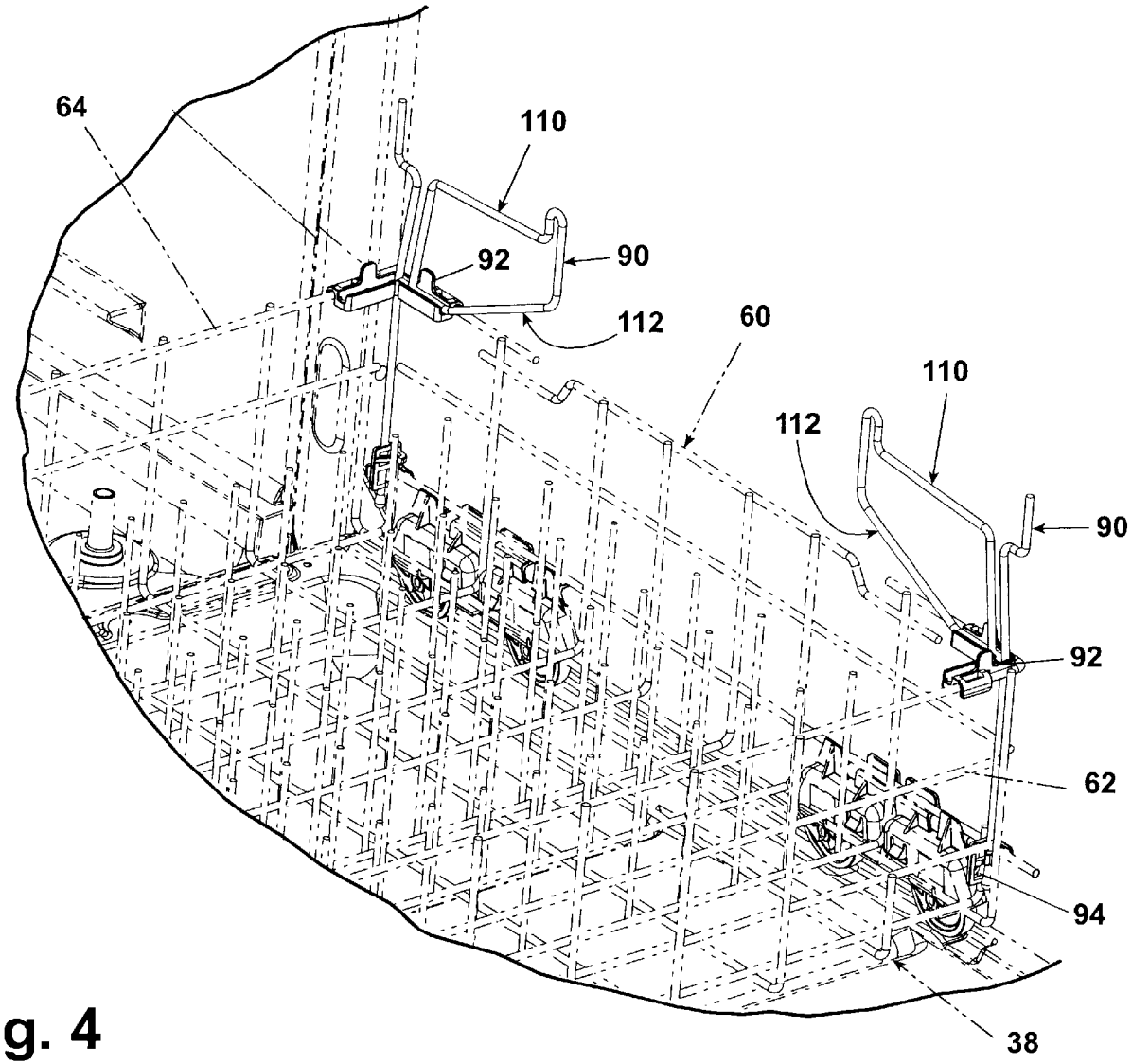
FIG. 4 is a perspective view similar to FIG. 3 except that the auxiliary basket supports are shown in a stored position.
Figure 5:
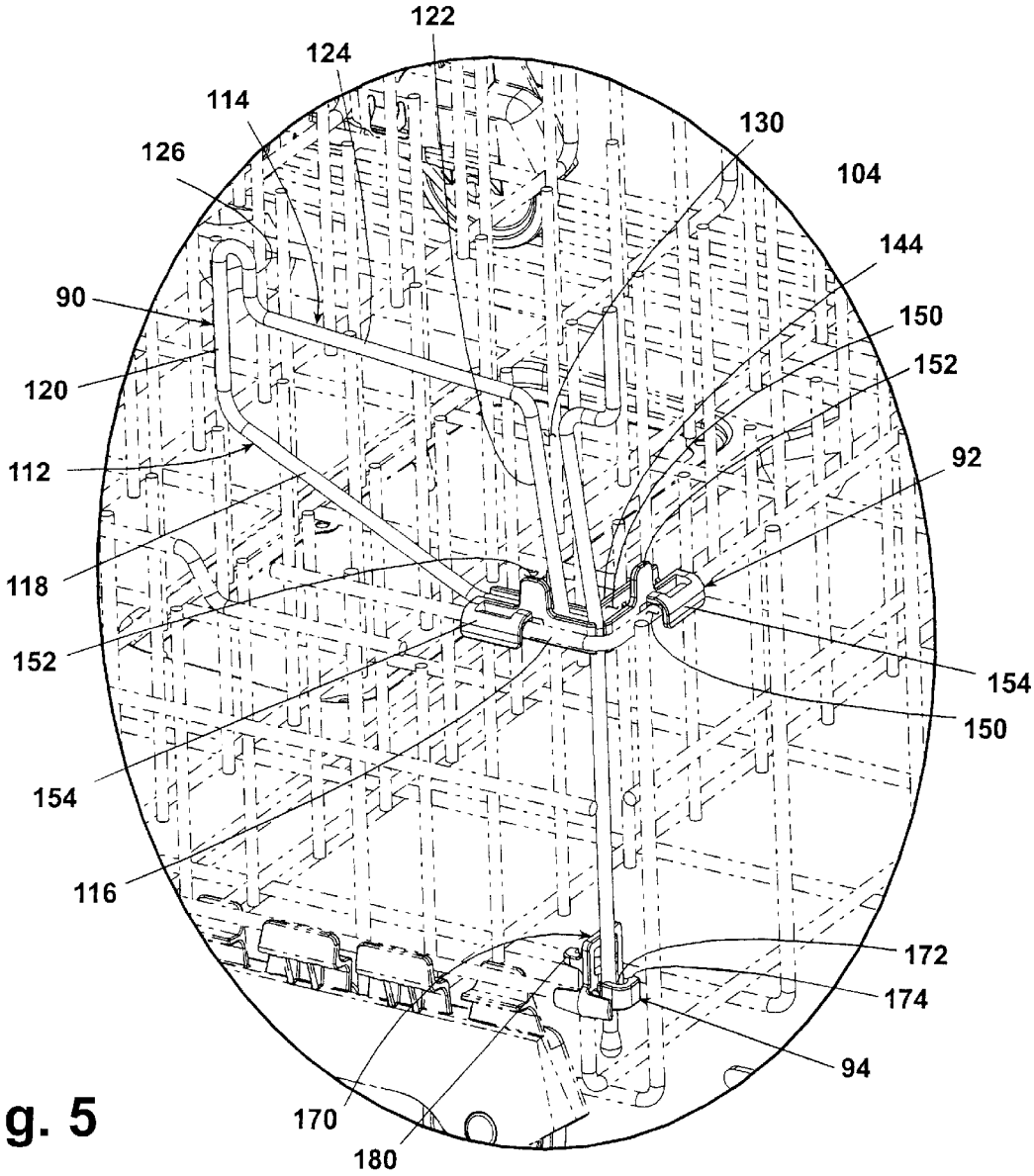
FIG. 5 is an enlarged perspective view of one of the auxiliary basket supports of FIG. 4 illustrating the fastener system for securing the support to the lower basket.
Figure 6:
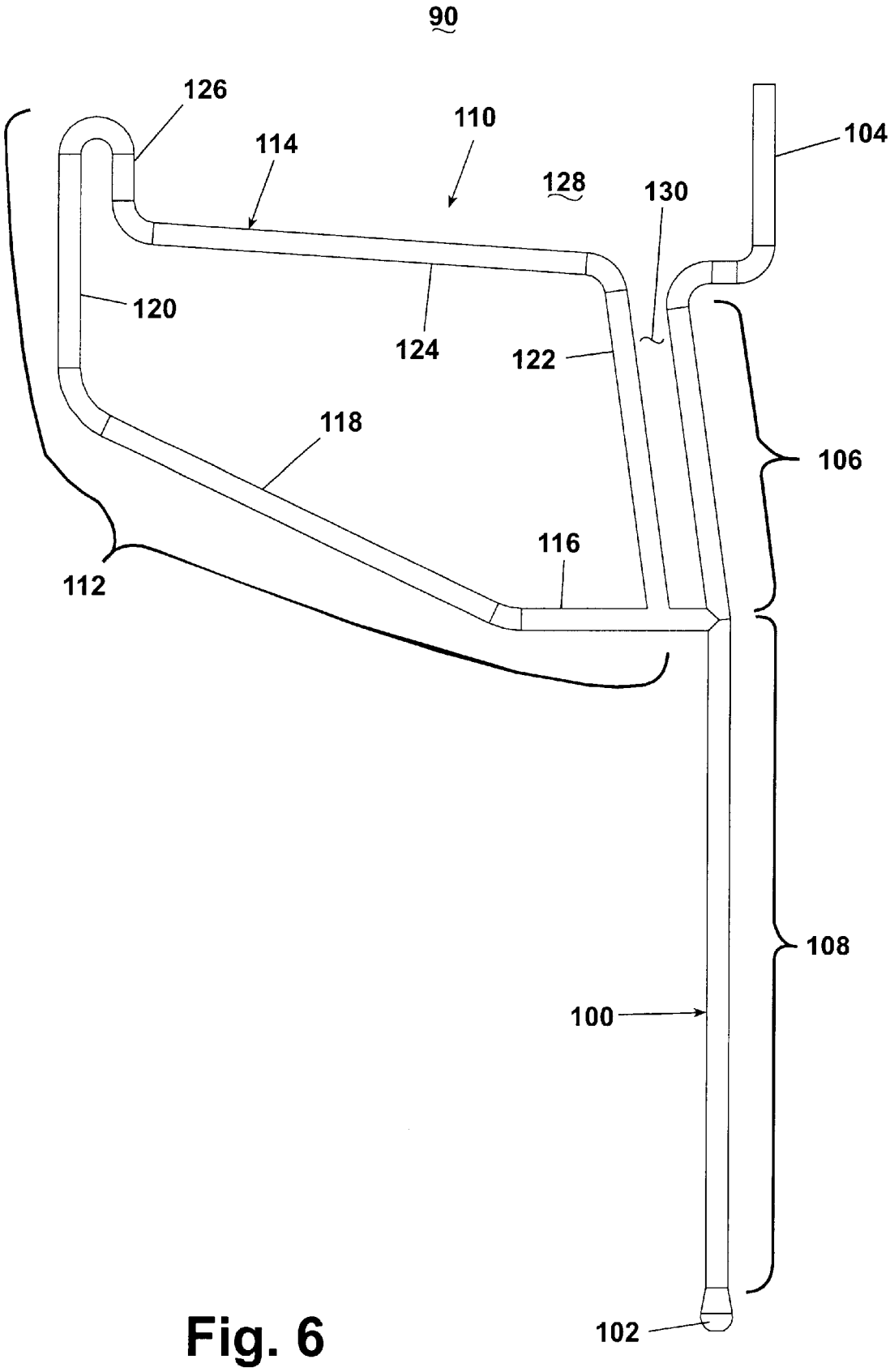
FIG. 6 is a side view of one of the auxiliary basket supports.

Referring now to FIG. 6 specifically and FIGS. 3–5 generally, each of the supports 90 comprises a substantially vertically oriented post 100 terminating in an enlarged portion 102 at one end and terminating in an L-shaped bend 104 at another end. The post 100 comprises a generally angled portion 106 extending from a generally straight portion 108. The support 90 further comprises an arm 110 that comprises a cantilevered support 112 that supports a base 114.

The cantilevered support 112 comprises a downwardly angled portion 116, an upwardly angled portion 118, and an end portion 120. The downwardly angled portion 116 preferably originates at the intersection of the angled portion 106 and straight portion 108 of the post 100. The base 114 comprises an angled portion 122, a horizontal portion 124 and a vertical portion 126.

A recess 128 is defined by the L-shaped bend 104 of the post 100 and the vertical portion 126 and the horizontal portion 124 of the arm 110. The recess 128 is preferably sized to receive the carrier members 82 such that they rest on the horizontal portion 124 of the arm and the lower leg of the L-shaped bend 104. The vertical portion 126 of the arm 110 and the upper leg of the L-shaped bend 104 effectively form stops that limit the movement of the carrier member 82 relative to the supports 90.

Figure 10:
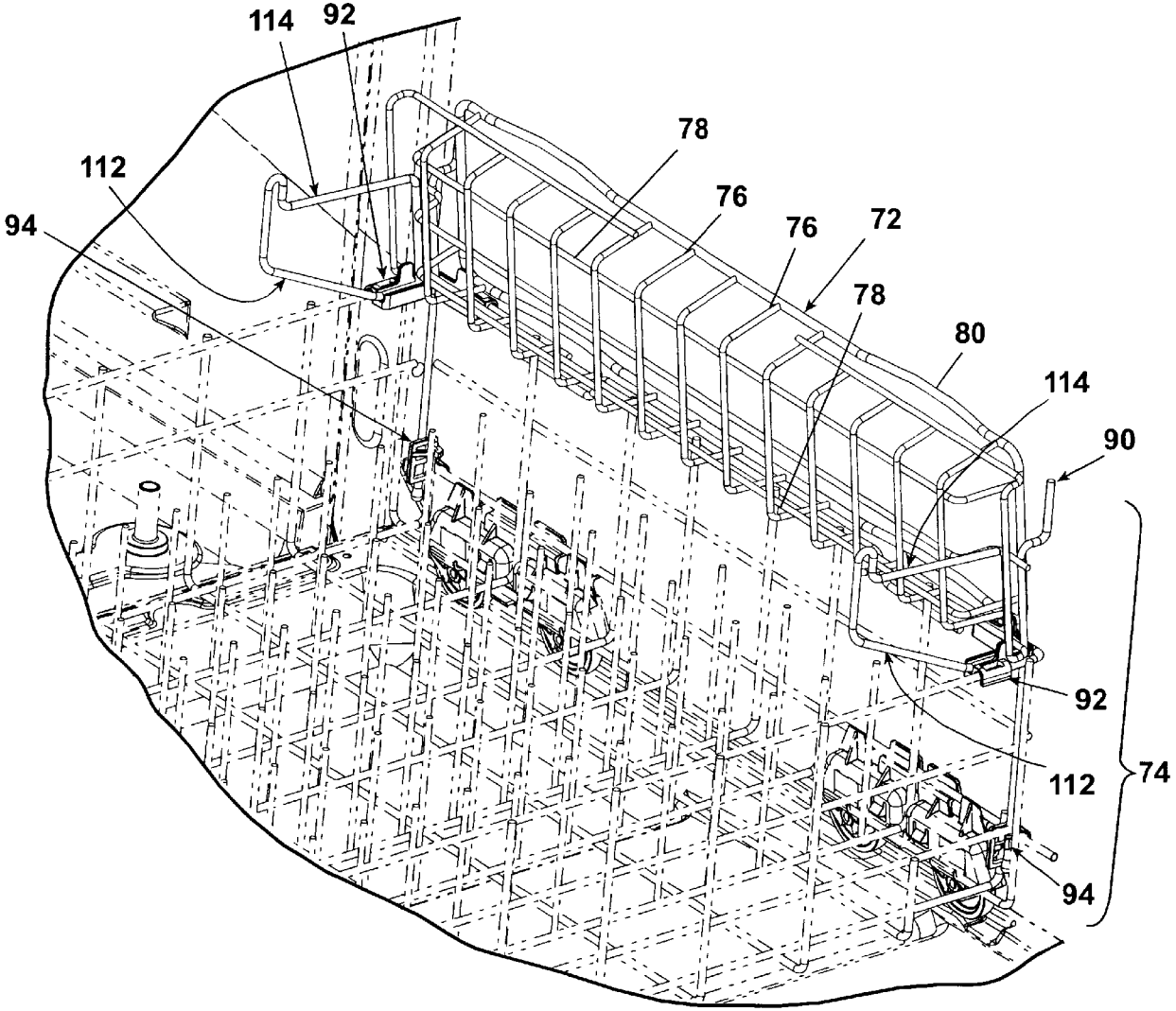
FIG. 10 is a perspective view similar to FIG. 2 except that the auxiliary basket is shown in a stored position.

A storage slot 130, which opens into the recess 128, is defined by the space between the angled portions 106 and 122 of the post 100 and arm 110, respectively. The storage slot 130 preferably has a width that is at least equal to the thickness of the wire forming the carrier member 82. Thus, as seen in FIG. 10, the carrier members 82 of the auxiliary basket 72 can be received within the storage slot 130 to orient the auxiliary basket 72 in stored position where it is substantially adjacent the side wall 60 and does not interfere with access to the lower basket 38.

Figure 7:
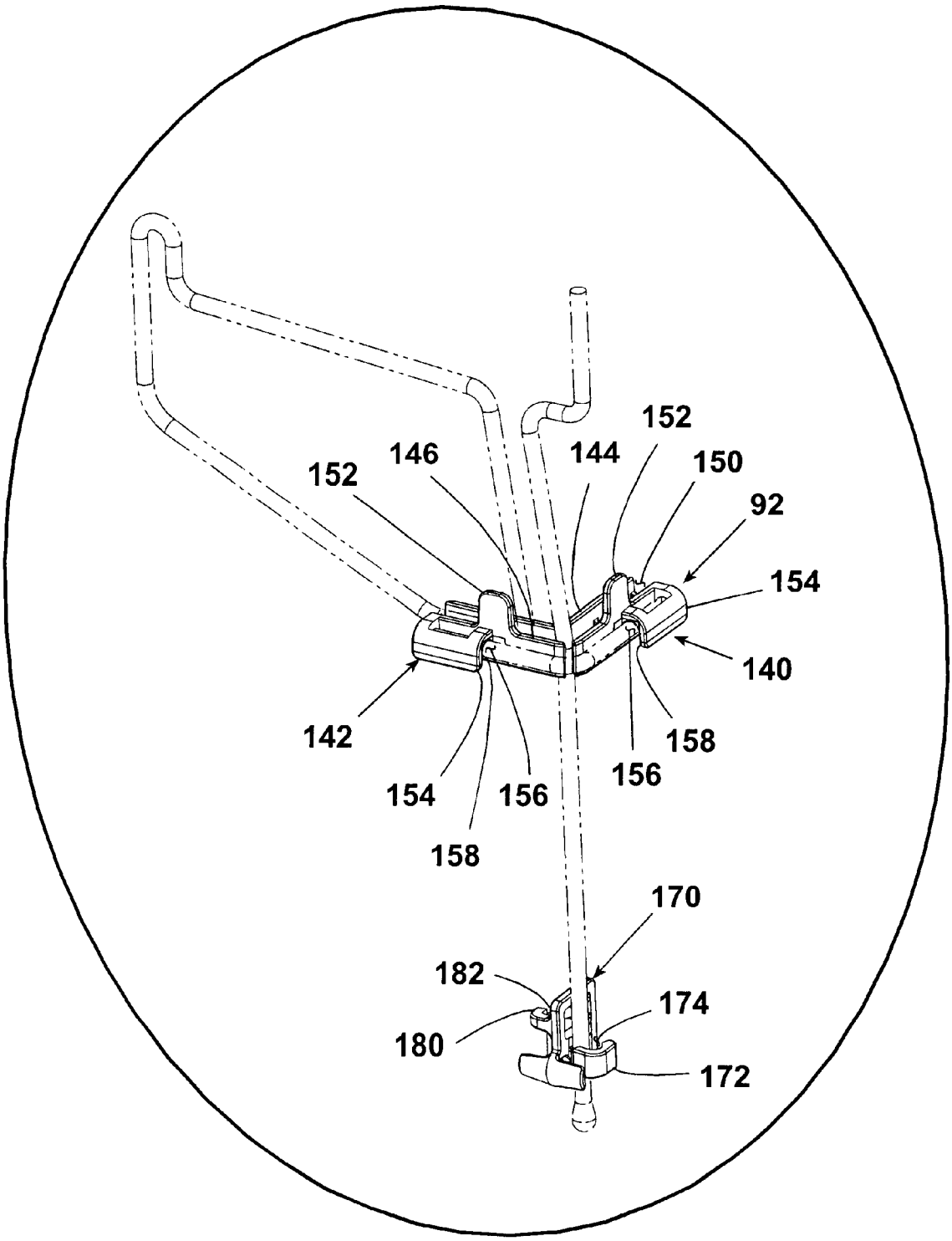
FIG. 7 is a perspective view of the clip system of FIG. 6 with the auxiliary basket support shown in phantom for clarity.
Figure 8:
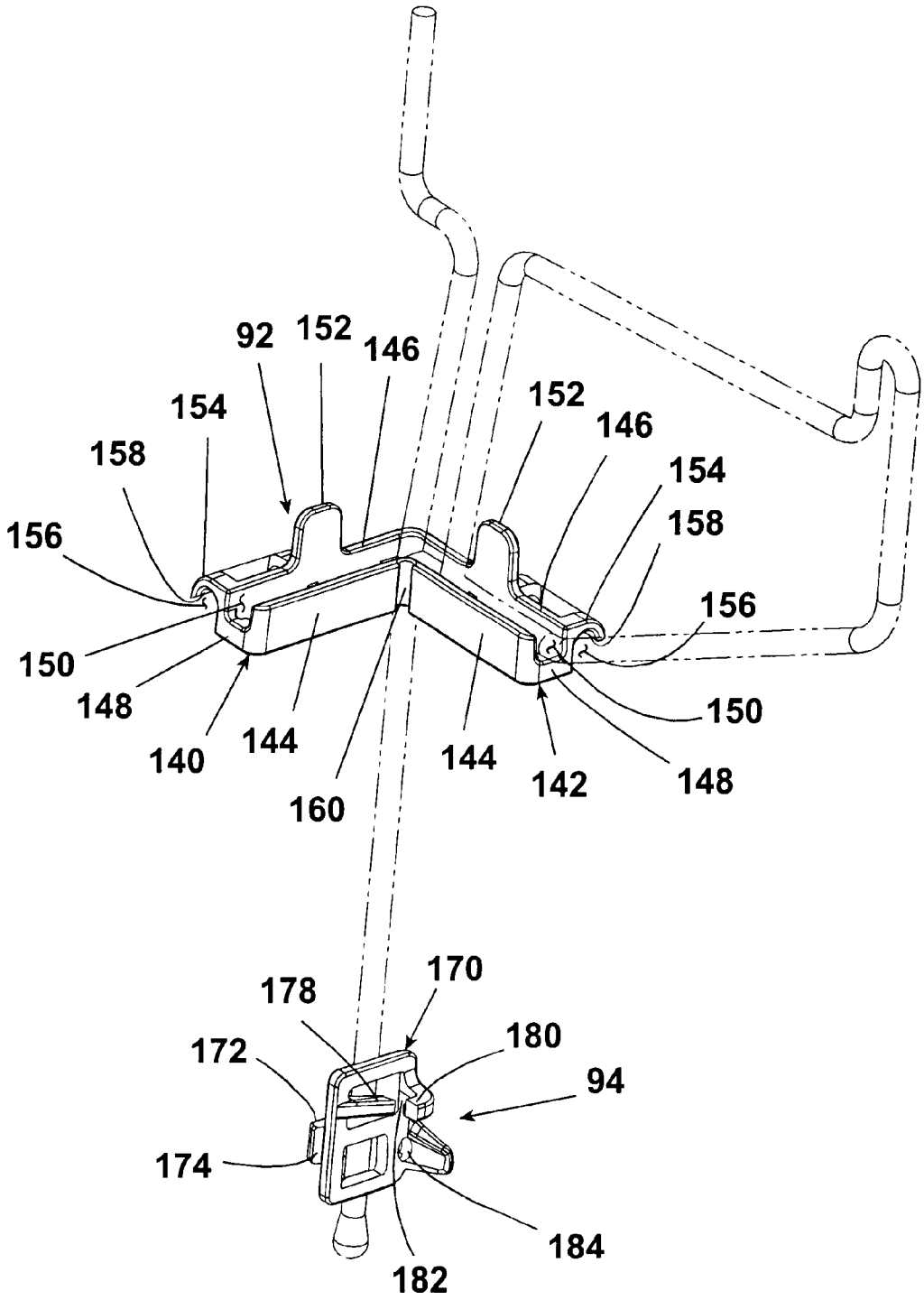
FIG. 8 is a perspective view similar to FIG. 7, except viewed from the opposite side as shown in FIG. 7.
Figure 9:
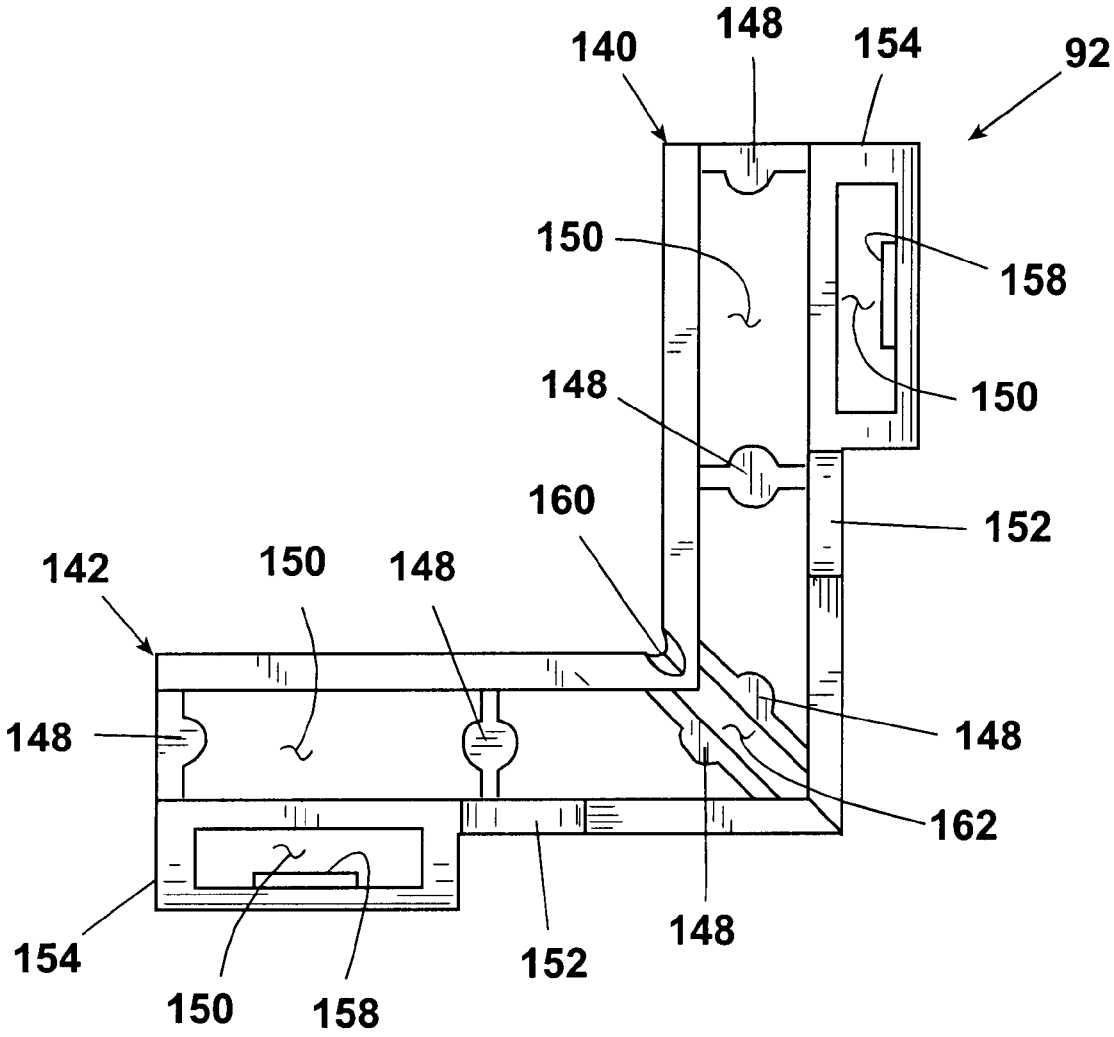
FIG. 9 is a top view of an upper clip of the clip system.

Referring specifically to FIGS. 7–9 and generally to FIGS. 4–6, the upper clip 92 comprises first and second legs 140, 142 that are mirror images of each other. Each of the legs includes a front wall 144 and rear wall 146 that are connected by webs 148, which collectively define a channel 150. A guide tab 152 extends upwardly from the rear wall 146. A spring arm 154 has a generally arcuate cross section and extends from the rear wall to define a mounting channel 156 into which a detent 158 extends. A living hinge 160 connects the front wall 144 of each leg and permits the relative rotation of each leg about the living hinge 160. An opening 162 is defined at the junction of the legs 140, 142 by the living hinge 160, webs 148, and rear walls 146. The opening is sized to receive the post 100.

The lower clip 94 comprises a vertically oriented main body 170 from which extends a spring arm 172 that defines a channel 174 sized to receive the straight portion 108 of the post 100. A spring finger 178 extends from a forward edge of the body 170 and terminates before reaching an arcuate support finger 180. The spacing of the end of the spring finger 178 and the support finger 180 forms a gap 182 that is sufficient in size to permit a portion of the lower basket to be pressed through the gap and behind the spring finger 178 to retain the lower clip to the lower basket 38.

The lower clip 94 further comprises an opening 184 in the body 170 through which is received one of the wire frame elements of the lower basket 38 to further mount the lower clip 94 to the side wall of the lower basket 38. The receipt of the wire frame member into the opening 184 effectively fixes the vertical position of the lower clip 94 relative to the side wall 60 of the lower basket 38.

To mount the supports 90 to the lower basket 38, the lower clip 94 is mounted to the side wall 60 of the lower basket 38 by inserting a horizontally oriented wire frame member through the opening 184 and snap-fitting a vertically oriented wire frame member of the side wall 60 into a gap 182 between the spring finger 178 and support finger 180. The upper clip 92 is temporarily mounted to the post 100 of the support 90 by rotating the legs 140, 142 about the living hinge 160 to separate the rear walls 146 a sufficient distance so that the post 100 can be received therebetween and within the opening.

Once the upper clip 92 is temporarily mounted to the post 100, the sub-assembly of the support 90 and upper clip 92 are mounted to the lower basket 38 by snap-fitting horizontally oriented wire frame members of the side wall and the front wall into the mounting channel 156 of each leg until the detent 158 is received beneath the wire frame member. In this position, the channels 150 formed by the first and second legs 140, 142 are oriented generally at right angles to each other and parallel to the corresponding side wall and front wall.

To complete the assembly, the straight portion 108 of the post 100 is snap-fit to the lower clip 94 by pressing the straight portion 108 into the channel 174 defined by the spring arm 172 and the body 170.

When the support 90 is mounted to the lower basket 38 in this manner, the support 90 can be rotated between a use position as illustrated in FIG. 4 and a stored position as illustrated in FIG. 5. In the use position, the downwardly angled portion 116 of the base 114 is received in the channel 150 of the first leg 140. To move the support 90 from the use position to the stored position, the user merely lifts up on the support 90 a sufficient amount so that the downwardly angled portion 116 clears the channel 150 of the first leg 140. The user then rotates the support 90 until the downwardly angled portion 116 overlies the channel 150 of the second leg 142. The user then lowers the support until the downwardly angled portion 116 is received within the channel 150 of the second leg 142. In the stored position, the support 90 is generally aligned with the side wall 60 and does not interfere with access to the lower basket 38.

The advantage of moving the supports 90 between the stored and use positions is very useful in the everyday operation of the automatic dishwasher. The ability to position the supports in the stored position with the auxiliary basket removed provides the user with easy access to the utensil receiving area 67, which greatly simplifies the loading and unloading of the utensils from the utensil receiving area without the supports or the auxiliary basket interfering with the user having access to items in the utensil receiving area beneath the auxiliary basket if it had to be maintained in the use position.

The auxiliary basket support assembly is also very flexible. The clips 92 and 94 permit the supports to be mounted at any location along the peripheral wall. It is within the scope of the invention for the supports to be located along any combination of the front wall, rear wall or sidewalls to effect other auxiliary basket orientations than the front-to-rear orientation as illustrated. For example, the supports could be placed along the front or rear walls with the auxiliary basket having a sidewall-to-sidewall orientation. Although not preferred, the supports could be mounted on the opposing sidewalls and the auxiliary basket would span the utensil receiving area. However, to reduce the possibility of interference, it is preferred that the supports be located such that the auxiliary basket is parallel to and adjacent one of the front, rear, or sidewalls.

Another advantage of the invention is that the supports can be arranged along the wall to support any length auxiliary basket. The auxiliary basket does not have to be of the same length as the corresponding front, rear or sidewall. There can also be multiple sets of support arms to support multiple auxiliary baskets.

The auxiliary basket support system is also advantageous in that it permits the auxiliary basket to be stored, not removed, within the automatic dishwasher while minimizing the space consumed by the auxiliary. The storage slots on the supports permit the basket to be oriented in a generally vertical position so that the smaller height dimension (instead of the width) faces the access opening. Many users will find this a welcome compromise as it does not require entirely removing the auxiliary basket, which can result in the misplacing of the auxiliary basket.

In short, the auxiliary basket assembly provides a very versatile system for providing and using an auxiliary basket within an automatic washer. The auxiliary basket can be positioned almost anywhere within any basket at any orientation. The basket can be completely removed or left within the wash chamber and oriented to minimize interference with the loading and unloading of the utensil area.

While the invention has been specifically described in connection with certain specific embodiments thereof, it is to be understood that this is by way of illustration and not of limitation, and the scope of the appended claims should be construed as broadly as the prior art will permit.

What is claimed is:

1. A dishwasher for washing cooking utensils comprising:

a cabinet defining a wash chamber and an access opening providing access to the wash chamber;

a door moveably mounted to the cabinet for movement between an opened position, where the door is away from the access opening for permitting access to the wash chamber, and a closed position, where the door covers the access opening for prohibiting access to the wash chamber;

a first basket comprising a bottom wall, opposing front and rear walls, and opposing side walls connecting the front and rear walls to form a peripheral wall extending upwardly from the bottom wall, and the first basket is moveably mounted within the wash chamber for movement between a stored position, where the first basket is received within the wash chamber such that the front wall is adjacent the door when closed, and a use position, where at least a portion of the basket extends through the access opening and exteriorly of the cabinet; and an auxiliary basket assembly comprising:

an auxiliary basket removably mounted to the first basket; and an auxiliary basket support assembly for supporting the auxiliary basket above the first basket when the auxiliary basket is used and comprising at least one support rotatably mounted to the first basket for rotation between a support position, where the support is positioned to support at least a portion of the auxiliary basket, and a retracted position, where the support does not interfere with access to the first basket.

2. The dishwasher according to claim 1, wherein the auxiliary basket support assembly supports the auxiliary basket in one of a side wall-to-side wall or front wall-to-rear wall orientation.

3. The dishwasher according to claim 2, wherein when the auxiliary basket is in the side wall-to-side wall orientation and the at least one support is in the support position, the at least one support is generally parallel to one of the side walls.

4. The dishwasher according to claim 2, wherein when the auxiliary basket is in the front wall-to-rear wall orientation and the at least one support is in the support position, the at least one support is generally parallel to one of the front and rear walls.

5. The dishwasher according to claim 1, and further comprising a second basket moveably mounted within the wash chamber.

6. The dishwasher according to claim 5, wherein the second basket is disposed above the first basket.

7. The dishwasher according to claim 1, wherein the auxiliary basket is supported by the auxiliary basket support above the peripheral wall.

8. The dishwasher according to claim 1, wherein the at least one support comprises a post and an arm extending from the post, the post is generally parallel to a portion of the peripheral wall and rotatably mounted thereto, and the arm overlies the first basket when the support is in the support position.

9. The dishwasher according to claim 8, wherein the post is located at a junction of one of the side walls and one of the front and rear walls, wherein when the support is in the retracted position, the arm is substantially aligned with and adjacent one of the side walls or rear wall.

10. The dishwasher according to claim 9, wherein the post is aligned with and adjacent one of the side walls in the retracted position when the auxiliary basket is mounted to the first basket in an orientation extending from the front wall to the rear wall.

11. The dishwasher according to claim 9, and further comprising a second support located at a junction of the one of the side walls and the other of the front and rear walls.

12. The dishwasher according to claim 8, wherein the arm and the post define a recess having a substantially horizontal orientation and in which is received a portion of the auxiliary basket when the auxiliary basket is mounted to the first basket to fix the location of the auxiliary basket relative to the support.

13. The dishwasher according to claim 12, wherein the arm and the post define a substantially vertically oriented slot sized to receive at least a portion of the auxiliary basket and retain the basket in a substantially vertical orientation for storing the basket when not in use.

14. The dishwasher according to claim 13, wherein the slot has a mouth which opens into the recess.

15. The dishwasher according to claim 14, wherein the arm and post are made of shaped wire, the arm comprises a base portion that terminates in an arm stop, the post comprises a base portion, extending in a direction opposite of the arm base portion, and terminating in a post stop, wherein the recess is defined by the arm and post base portions and their corresponding stops.

16. The dishwasher according to claim 8, and further comprising a first clip mounting the support to the first basket for rotation relative to the peripheral wall, the first clip comprising an opening and first and second channels extending away from the opening and angularly oriented to each other, wherein the support can be raised relative to the first clip and then rotated and lowered relative to the first clip such that the arm is received in the first channel, when the support is in the support position, and the arm is received in the second channel when the support is in the retracted position.

17. The dishwasher according to claim 16, wherein the first clip is mounted at a junction of the one of the side walls with one of the front and rear walls.

18. The dishwasher according to claim 17, wherein the first and second channels are oriented at a right angle relative to each other.

19. The dishwasher according to claim 18, and further a second clip mounted to the basket and defining a second opening through which the post passes and the post has an enlarged portion located below the second opening, and the enlarged portion cannot pass through the second opening to limit the raising of the support relative to the first basket.

20. The dishwasher according to claim 19, wherein the first clip is mounted to the peripheral wall and the second clip is mounted to at least one of the peripheral wall and bottom wall.

21. The dishwasher according to claim 1, wherein the auxiliary basket support assembly further comprises a second support, wherein the first support is located at a junction of one of the side walls and the front wall and the second support is located at a junction of the one of the side walls and the rear wall.

22. The dishwasher according to claim 21, wherein the second support is mounted to the basket for relative rotation thereto.

23. An auxiliary basket assembly for a dishwasher, which comprises:

a cabinet defining a wash chamber and an access opening providing access to the wash chamber;

a door moveably mounted to the cabinet for movement between an opened position, where the door is away from the access opening for permitting access to the wash chamber, and a closed position, where the door covers the access opening for prohibiting access to the wash chamber;

a basket comprising a bottom wall, opposing front and rear walls, and opposing side walls connecting the front and rear walls to form a peripheral wall extending upwardly from the bottom wall, with the peripheral wall and bottom wall defining a utensil receiving area, and the basket is moveably mounted within the wash chamber for movement between a stored position, where the basket is received within the wash chamber such that the front wall is adjacent the door when closed, and a use position, where at least a portion of the basket extends through the access opening and exteriorly of the cabinet;

the auxiliary basket assembly comprising:

an auxiliary basket removably mounted to the basket; and an auxiliary basket support assembly for supporting the auxiliary basket above the utensil receiving area when the auxiliary basket is used and having at least one support rotatably mounted to the basket for rotation between a support position, where the support is positioned to support at least a portion of the auxiliary basket, and a retracted position, where the support does not interfere with access to the utensil receiving area.

24. The auxiliary basket assembly according to claim 23, wherein the at least one support comprises a post and an arm extending from the post, and further comprising a first clip mounting the support to the first basket for rotation relative to the peripheral wall, the first clip comprising an opening and first and second channels extending away from the opening and angularly oriented to each other, wherein the support can be raised relative to the first clip and then rotated and lowered relative to the first clip such that the arm is received in the first channel, when the support is in the support position, and the arm is received in the second channel when the support is in the retracted position.

25. The auxiliary basket assembly according to claim 24, wherein the first clip is mounted at a junction of the one of the side walls with one of the front and rear walls.

26. The auxiliary basket assembly according to claim 25, and further comprising a second clip mounted to the basket and defining a second opening through which the post passes and the post having an enlarged portion located below the second opening, and the enlarged portion cannot pass through the opening and limits the raising of the support relative to the first basket.

27. The auxiliary basket assembly according to claim 26, wherein the first clip is mounted to the peripheral wall and the second clip is mounted to at least one of the peripheral wall and bottom wall.

28. The auxiliary basket assembly according to claim 27, wherein the arm and the post define a recess in which is received a portion of the auxiliary basket when the auxiliary basket is mounted to the first basket.

29. The auxiliary basket assembly according to claim 28, wherein the arm and the post define a substantially vertically oriented slot sized to receive at least a portion of the auxiliary basket and retain the basket in a substantially vertical position.

30. The auxiliary basket assembly according to claim 29, wherein the arm and post are made of shaped wire, the arm comprises a base portion that terminates in an arm stop, the post comprises a base portion, extending in a direction opposite of the arm base portion, and terminating in a post stop, wherein the recess is defined by the arm and post base portions and their corresponding stops.

31. The auxiliary basket assembly according to claim 30, wherein the auxiliary basket support assembly further comprises a second support, wherein the first support is located at a junction of one of the side walls and the front wall and the second support is located at a junction of the one of the side walls and the rear wall.

32. The auxiliary basket assembly according to claim 31, wherein the second support is mounted to the basket for relative rotation thereto.

33. A dishwasher for washing cooking utensils comprising:

a cabinet defining a wash chamber and an access opening providing access to the wash chamber;

a door moveably mounted to the cabinet for movement between an opened position, where the door is away from the access opening for permitting access to the wash chamber, and a closed position, where the door covers the access opening for prohibiting access to the wash chamber;

a first basket comprising a bottom wall, opposing front and rear walls, and opposing side walls connecting the front and rear walls to form a peripheral wall extending upwardly from the bottom wall, and the first basket is moveably mounted within the wash chamber for movement between a stored position, where the first basket is received within the wash chamber such that the front wall is adjacent the door when closed, and a use position, where at least a portion of the basket extends through the access opening and exteriorly of the cabinet; and an auxiliary basket assembly comprising:

an auxiliary basket removably mounted to the first basket; and first and second spaced supports mounted to the first basket, each of the supports having an arm for supporting the auxiliary basket above the first basket in a use position and a generally vertically-oriented slot for receiving and holding the auxiliary basket in a stored position.

34. The dishwasher according to claim 33, wherein the supports are mounted to the peripheral wall such that they support the basket in one of a side wall-to-side wall and front wall-to-rear wall orientation.

35. The dishwasher according to claim 33, wherein the supports further comprise a post from which the arm extends and the post is generally parallel to a portion of the peripheral wall.

36. The dishwasher according to claim 35, wherein at least one of the supports is rotatably mounted to the peripheral wall whereby the support can be rotated between a use position, where the arm is extended to support the auxiliary basket, and a stored position, where the arm is retracted.

37. The dishwasher according to claim 36, wherein each post is located at a junction of one of the side walls and one of the front and rear walls.

38. The dishwasher according to claim 35, wherein the arm and the post define a recess having a substantially horizontal orientation for receiving a portion of the auxiliary basket.

39. The dishwasher according to claim 38, wherein the slot is formed by the arm and the post.

40. The dishwasher according to claim 39, wherein the slot has a mouth which opens into the recess.

41. A dishwasher for washing cooking utensils comprising:

a cabinet defining a wash chamber and an access opening providing access to the wash chamber;

a door moveably mounted to the cabinet for movement between an opened position, where the door is away from the access opening for permitting access to the wash chamber, and a closed position, where the door covers the access opening for prohibiting access to the wash chamber;

a first basket comprising a bottom wall, opposing front and rear walls, and opposing side walls connecting the front and rear walls to form a peripheral wall extending upwardly from the bottom wall, and the first basket is moveably mounted within the wash chamber for movement between a stored position, where the first basket is received within the wash chamber such that the front wall is adjacent the door when closed, and a use position, where at least a portion of the basket extends through the access opening and exteriorly of the cabinet; and an auxiliary basket assembly comprising:

an auxiliary basket removably mounted to the first basket; and first and second supports rotatably mounted in spaced relationship to one of the side walls, each of the supports having an arm for supporting the auxiliary basket above the first basket in a use position and a generally vertically-oriented slot for receiving and holding the auxiliary basket in a stored position;

wherein each of the arms can be rotated between an extended position, where the arms can support the basket, and a retracted position, where the arms are adjacent the one of the side walls.

42. The dishwasher according to claim 41, wherein the supports further comprise a post from which the arm extends and the post is generally parallel to a portion of the peripheral wall.

43. The dishwasher according to claim 42, wherein the arm and the post define a recess having a substantially horizontal orientation for receiving a portion of the auxiliary basket.

44. The dishwasher according to claim 43, wherein the slot is formed by the arm and the post.

45. The dishwasher according to claim 44, wherein the slot has a mouth which opens into the recess.

46. The auxiliary basket assembly according to claim 42, and further comprising a first clip mounting the support to the first basket for rotation relative to the peripheral wall, the first clip comprising an opening and first and second channels extending away from the opening and angularly oriented to each other, wherein the support can be raised relative to the first clip and then rotated and lowered relative to the first clip such that the arm is received in the first channel, when the support is in the support position, and the arm is received in the second channel when the support is in the retracted position.

47. The auxiliary basket assembly according to claim 46, wherein the first clip is mounted at a junction of the one of the side walls with one of the front and rear walls.

48. The auxiliary basket assembly according to claim 47, and further comprising a second clip mounted to the basket and defining a second opening through which the post passes and the post having an enlarged portion located below the second opening, and the enlarged portion cannot pass through the opening and limits the raising of the support relative to the first basket.

* * * * *